US011142019B2

(12) United States Patent
Goto et al.

(10) Patent No.: US 11,142,019 B2
(45) Date of Patent: Oct. 12, 2021

(54) DECORATED-PART HAVING A FINE DECORATION USING A LASER PROCESSED GROOVE

(71) Applicant: TRINITY INDUSTRIAL CORPORATION, Aichi (JP)

(72) Inventors: Yukihiro Goto, Aichi (JP); Tadayuki Mizobe, Aichi (JP); Tokinobu Shimada, Aichi (JP)

(73) Assignee: TRINITY INDUSTRIAL CORPORATION, Aichi (JP)

( * ) Notice: Subject to any disclaimer, the term of this patent is extended or adjusted under 35 U.S.C. 154(b) by 0 days.

(21) Appl. No.: 16/010,550

(22) Filed: Jun. 18, 2018

(65) Prior Publication Data

US 2018/0370276 A1 Dec. 27, 2018

(30) Foreign Application Priority Data

Jun. 21, 2017 (JP) ..... JP2017-121761

(51) Int. Cl.
*B44C 1/22* (2006.01)
*B44C 1/18* (2006.01)
(Continued)

(52) U.S. Cl.
CPC ..... *B44C 1/18* (2013.01); *B44C 1/20* (2013.01); *B44C 1/228* (2013.01); *B44C 3/005* (2013.01)

(58) Field of Classification Search
CPC ..... B23K 26/0006; B23K 26/0063; B23K 26/0066; B23K 26/0081; B23K 26/352;
(Continued)

(56) References Cited

U.S. PATENT DOCUMENTS 6,169,266 B1 * 1/2001 Hughes ..... B41M 5/24 219/121.68
2006/0044324 A1 * 3/2006 Shum ..... G06T 11/001 345/595

(Continued)

FOREIGN PATENT DOCUMENTS

| | | |
|---|---|---|
| JP | 2-260335 | 10/1990 |
| JP | 10-223083 | 8/1998 |
| JP | 2010-063993 | 3/2010 |

OTHER PUBLICATIONS

Colors as Hue, Saturation and Brighness. Obtained from georeference.org on Apr. 22, 2020. (Year: 2012).*

*Primary Examiner* — Megha M Gaitonde
(74) *Attorney, Agent, or Firm* — Clark & Brody LP

(57) ABSTRACT

A method for manufacturing a decorated-part comprises a first and second base coat-layer-forming process, a surface coat-layer-forming process and a laser-decorating process. In the first base coat-layer-forming process, the first base coat-layer colored in a highly light color at a lightness-level of 70 or more is formed on the surface of the resin base-material 12. In the second base coat-layer-forming process, the second base coat-layer 21C colored in a chromatic color is formed on the first base coat-layer. In the surface coat-layer-forming process, the surface coat-layer colored in a less-bright color at a lightness-level of 20 or less is formed on the second base coat-layer 21C. In the laser-decorating process, the first laser-processed groove penetrating the surface coat-layer and exposing partially the second base coat-layer is made by irradiating the infrared laser onto such surface coat-layer, thus providing a fine decoration onto the surface of said decorated-part.

3 Claims, 6 Drawing Sheets

(51) Int. Cl.
*B44C 3/00* (2006.01)
*B44C 1/20* (2006.01)

(58) Field of Classification Search
CPC .... B23K 26/354; B23K 26/36; B23K 26/362; B23K 26/364; Y10T 428/24479; Y10T 428/24521; Y10T 428/24545; B32B 3/26; B32B 3/266; B32B 3/30
USPC ..... 428/156, 161, 164, 172, 173; 219/121.6, 219/121.61, 121.62
See application file for complete search history.

(56) References Cited

U.S. PATENT DOCUMENTS

2010/0021695 A1* 1/2010 Naoyuki ..... B41N 1/06 428/173
2013/0270269 A1* 10/2013 Lewis ..... B65D 17/4012 220/270
2015/0166844 A1* 6/2015 Clarke ..... B29B 11/12 428/43

* cited by examiner

DECORATED-PART HAVING A FINE DECORATION USING A LASER PROCESSED GROOVE

TECHNICAL FIELD

This invention relates to a decorated-part of which fine decorations are provided on the surface thereof by irradiating a laser onto the coat-layer of such part and also relates to a method for manufacturing said part.

TECHNICAL BACKGROUND

In the field of automobile interior-parts or the like, the decorated-parts (e.g. console boxes, instrument panels, armrests or the like) of which a decoration such as a letter, a design or the like is added onto a coat-layer laminated onto the surface of a resin base-material for the purpose of improving the designs and product quality, are nowadays put to practical use.

A method for manufacturing such decorated-parts, as disclosed for example in Patent Document 1, is publicly known. This document shows a method for initially making a laminated coat-layer of a color that gets darker toward the bottom layer of such a coat-layer, and shows a method for drawing a design representing a wood-grain pattern by selectively laser processing such a laminated coat-layer in differing depths. In order to reduce the equipment cost, such laser processing preferably is executed by using a comparatively inexpensive infrared laser-processing device (e.g. of a laser wavelength of 1,064 nm).

PRIOR ARTS

Patent Documents

Patent Document 1: Japanese published unexamined application number 2010-63993

SUMMARY OF THE INVENTION

Problems to be Resolved by the Invention

Regarding automobile interior parts, it is common, in consideration of design effect and cost efficiency, to make the resin base-material of a deep color such as black or the like, and it is also general to make the surface coat-layer of a similar color (usually black) according to the color of the resin base-material. In the case that such a structure is applied, decoration is added onto the surface of said interior-parts by providing a fine laser-process on the black surface of the coat-layer. In doing so, there is the advantage that it is easy to provide infrared-laser processing onto the black surface of such a coat-layer. Contrarily, there is the disadvantage that it is impossible to express a chromatic color. The inventors of this invention are considering a new decorative-method of which a base coat-layer of high brightness and of high saturation, e.g. a chromatic color such as red or the like, is provided on the bottom level of the black surface of the coat-layer. Then, a laser-processed groove can be formed on just the surface coat-layer to expose such a chromatic-colored base coat-layer, thus partially providing a vivid accent on said black base.

However, in removing the black surface coat-layer by laser-processing causes the problem that the resin base-material that is of a deep color such as black or the like to absorb the laser-light energy, thus causing the resin on the surface of such base material to be gasified into an air-foam, thus forming a bulge on the surface of such base coat-layer. In which case, the reflectance of the base coat-layer is reduced, because the flatness of the base coat-layer is not realized, and the incoming air makes the base coat-layer to become cloudy or the like with an indistinct coloring and insufficient color contrast, thus presumably making it difficult to achieve a decorated-part of an excellent design. Also, the adhesion of the base coat-layer against the resin base-material is reduced, thus presumably making it difficult to achieve a reliable decorated-part.

This invention was achieved in light of the aforementioned problems and is aimed in providing a decorated part with a high design-quality and reliability, since the base coat-layer exposed on the surface of such coat-layer has no bulge, and thus the color of such coat-layer is distinctive.

Means of Solving the Problems

To solve the above-mentioned problems, the first aspect of this invention refers to a method for manufacturing a decorated-part of which a plurality of base coat-layers are formed on the surface of the resin base-material, of which the surface coat-layer that is colored in a less-bright color than that of the base coat-layer is formed on the base coat-layer, and of which a fine decoration is provided on the surface of such decorated-part by laser irradiation onto the surface coat-layer, and is characterized in comprising a first base coat-layer-forming process for forming a first base coat-layer colored at a high-lightness level of 70 or more, on the surface of the resin base material, and in comprising a second base coat-layer-forming process for forming at least one layer of the second base coat-layer that is colored in a chromatic color on the first base coat-layer; and in comprising a surface coat-layer-forming process for forming the surface coat-layer that is colored at a lower-lightness level of 20 or less on the second base coat-layer; and comprising a laser-decorating process of which the infrared-laser is irradiated onto the surface coat-layer through the surface coat-layer so as to make a first laser-processed groove that partially exposes the second base coat-layer, thus providing a fine decoration onto the surface of said decorated-part.

As such, in the first aspect of this invention, the laser-decorating process allows for irradiating the infrared laser onto the surface coat-layer, which partially removes the surface coat-layer so as to make the first laser-processed groove thereon, thus exposing the second base coat-layer at the place corresponding to the first laser-processed groove. Here, the first base coat-layer, colored at a high-lightness level of 70 or more, is formed on the resin-base material. Thus, the infrared laser is reflected by the first base coat-layer in the laser-decorating process, thus avoiding heat absorption. As such, the resin base-material is not gasified. Therefore, an air-foam-induced bulge is not readily formed. As such, the flatness of the area of the second base coat-layer exposed at the first laser-processed groove is realized, and the color of such area becomes distinctive, and the contrast becomes greater, thus making it possible to obtain a decorated part of an excellent design-quality. Furthermore, the adhesion of the base coat-layer against the resin base-material does not lessen, thus making it possible to obtain a reliable decorated-part.

The second aspect of this invention refers to the formation of the above first base-coat layer colored in white, milky-white, grayish-white or ivory with a lightness level of 70 or more in the first base coat-layer-forming process of the first aspect of this invention.

The second aspect of this invention allows for a secure infrared-laser reflection by the first base-coat layer. Therefore, it is surely possible to prevent an induced air-foam by gasification of the resin-base material.

The third aspect of this invention refers to the step that the second laser-processed groove of a shallower depth than that of the first laser-processed groove, and which does not penetrate the surface coat-layer, is also made on the surface of the coat-layer in the first or second aspect of this invention.

Therefore, the third aspect of this invention allows for the adding of the second laser-processed groove so that a complex and fine design can be expressed, thus making it possible to improve the excellency of the design.

The fourth aspect of this invention refers to the step that the second laser-processed groove is made after the making of the first laser-processed groove in the laser-decorating process of the third aspect of this invention.

If the second laser-processed groove of a relatively shallow groove is made first, and the first laser-processed groove of a relatively deep groove is made later, then much gas is produced in the making of the first laser-processed groove, which induces soot and smoke to gather in the second laser-processed groove, which could result in less gloss of the second laser-processed groove. Contrarily, the fourth aspect of this invention, about the first laser-processed groove being firstly made, stops smoke and soot from gathering in the second laser-processed groove, which eliminates the possibility of gloss deterioration, thus making it possible to obtain a decorated-part of a high quality-design.

The fifth aspect of this invention refers to a decorated-part of which a fine decoration is provided on the surface thereof by the laser-processed groove comprising a resin base-material; and comprising the first base coat-layer formed on the surface of the resin base-material and colored at a high-lightness level of 70 or more; and comprising at least one layer of second base coat-layer formed on the surface of the first base coat-layer and colored in a chromatic color; and comprising a surface coat-layer formed on the second base coat-layer and colored at a low-lightness level of 20 or less; and is further characterized in comprising a first laser-processed groove that goes through the surface coat-layer and partially exposes the second base coat-layer whereof the roughness (Ra) of the exposed area, which is at the bottom of the first laser-processed groove of the base coat-layer, is 2 μm or less.

Thus, the fifth aspect of this invention, whereof the roughness (Ra) of the exposed area of the second base coat-layer exposed in the first laser-processed groove is 2 μm or less, which makes the flatness of such area realized, the color of such an area becomes distinctive, and the contrast becomes greater, thus making it possible to obtain a decorated-part with a excellent design-quality. Furthermore, the adhesion of the base coat-layer against the resin base-material does not lessen, thus making it possible to obtain a reliable decorated-part.

Hence, the above statement "the roughness (Ra) of the exposed area of the second base coat-layer exposed at the bottom of the first laser-processed groove is 2 μm or less" is defined that the arithmetic-average roughness (Ra) of such exposed area of such second base coat-layer, which is measured by using a laser microscope, as being 100 μm in length in the transverse direction of the first laser-processed groove, is 2 μm or less. Also, the maximum height (Ry) of the exposed area of the second base coat-layer can be 7 μm or less, and the 10-point average roughness (Rz) of such exposed area of the second base coat-layer can be 8 μm or less. The reason for such a definition is that if the values of Ra, Ry and Rz exceed the above-mentioned ranges, the exposed area is not truly flat, which makes it difficult to achieve a preferable exposed area with distinctive coloring and great contrast.

The sixth aspect of this invention refers to the first base coat-layer according to the fifth aspect of this invention, that is colored in white, milky-white, grayish-white or ivory at a lightness-level of 70 or more.

The seventh aspect of this invention refers to the existence of a non-exposed area that is not at the bottom of the first laser-processed groove on the second base coat-layer of the fifth or sixth aspect of this invention, as well as to the average value in the height from the surface of the resin base-material as the standard point up to the surface of the exposed area is 100 or more and 130 or less under the condition that the average value in the height from the standard point, that is, from the surface of the resin base-material up to the surface of the non-exposed area, is 100.

As such, regarding the seventh aspect of this invention, if the average value in the height up to the surface of the exposed area is within the above range, under the condition that the average value in the height up to the surface of the non-exposed area is 100, the height of the bulge of the exposed area is less, and then the flatness of the exposed area is realized, which makes the color of such an area distinctive and the contrast greater, thus making it possible to obtain a decorated-part with an excellent design-quality. Furthermore, the adhesion of the base coat-layer against the resin base-material does not lessen, thus making it possible to obtain a reliable decorated-part.

The eighth aspect of this invention refers to the second base coat-layer according to the 6th or 7th aspect of this invention, that is colored in a chromatic color at a lightness-level of 30 or more and at a chromatic value of 40 or more.

As such, the eighth aspect of this invention that the lightness and chromatic value of the second base coat-layer are within the above ranges, allows for a secure formation of the exposed area with distinctive coloring and great contrast. It is preferable that the second base coat-layer is colored in a chromatic color at a lightness level of 30 or more and at a chromatic value of 45 or more, most preferably at a lightness level of 35 or more and at a chromatic value of 50 or more.

The ninth aspect of this invention refers to the thickness of the surface coat-layer that is greater than that of the second base coat-layer according to any one of the sixth through eighth aspects of this invention.

Making the thickness of the surface coat-layer less than that of the second base coat-layer may inhibit the function of the surface coat-layer as being a sufficient protective layer on the uppermost surface of the surface coat-layer. In addition, the thickness of the second base coat-layer should be minimal, since the second base coat-layer is simply for providing contrast. Increasing the thickness of the base coat-layer may unnecessarily result in higher costs in production. On the contrary, the ninth aspect of this invention, that the thickness of the surface coat-layer is greater than that of the second base coat-layer, can provide the function of the surface coat-layer as being a protective layer on the uppermost surface of the surface coat-layer and can also prevent an increase of unnecessary thickness of the second base coat-layer, thus making it possible to avoid higher costs in production. Therefore, the thickness of the surface coat-layer should be 20 μm to 40 μm, and the thickness of the second base coat-layer should be 10 μm to 20 μm.

The tenth aspect of this invention refers to the second laser-processed groove, according to any one of the sixth through the ninth aspects of this invention, which is of a shallower groove than the first laser-processed groove and which does not penetrate the surface coat-layer.

The tenth aspect of this invention adds the second laser-processed groove that can express a more complex and finer design, thus making it possible to improve the design-quality.

The eleventh aspect of this invention refers to the structure, according to the tenth aspect of this invention, that the width of the first laser-processed groove is greater than that of the second laser-processed groove.

In making both the first and second laser-processed grooves, making the width of the first laser-processed groove narrower than that of the second laser-processed groove makes it difficult to make the first laser-processed groove. More likely, the second base coat-layer makes it impossible to provide contrast in coloring. On the contrary, the ninth aspect of this invention makes it easy to make both the first and second laser-processed grooves. Then, the second base coat-layer can provide sufficient contrast in coloring, thus improving design-quality.

Effects of the Invention

As described above, the first through fourth aspects of this invention make the second base coat-layer, exposed at the surface coat-layer, free of a bulge and makes the coloring distinctive, thus making it possible to provide a method for manufacturing a reliable decorated-part of a high-quality design in a relatively easy and inexpensive way. Also, the fifth through eleventh aspects of this invention make the second base coat-layer, exposed at the surface coat-layer, free of a bulge and makes the coloring distinctive, thus making it possible to provide a reliable decorated-part of an excellent design-quality.

MODES FOR CARRYING OUT THE INVENTION

Hereinafter, an embodiment of this invention showing an automobile interior-part and a method for manufacturing the same is precisely described in reference to FIGS. 1 to 10.

Figure 1:
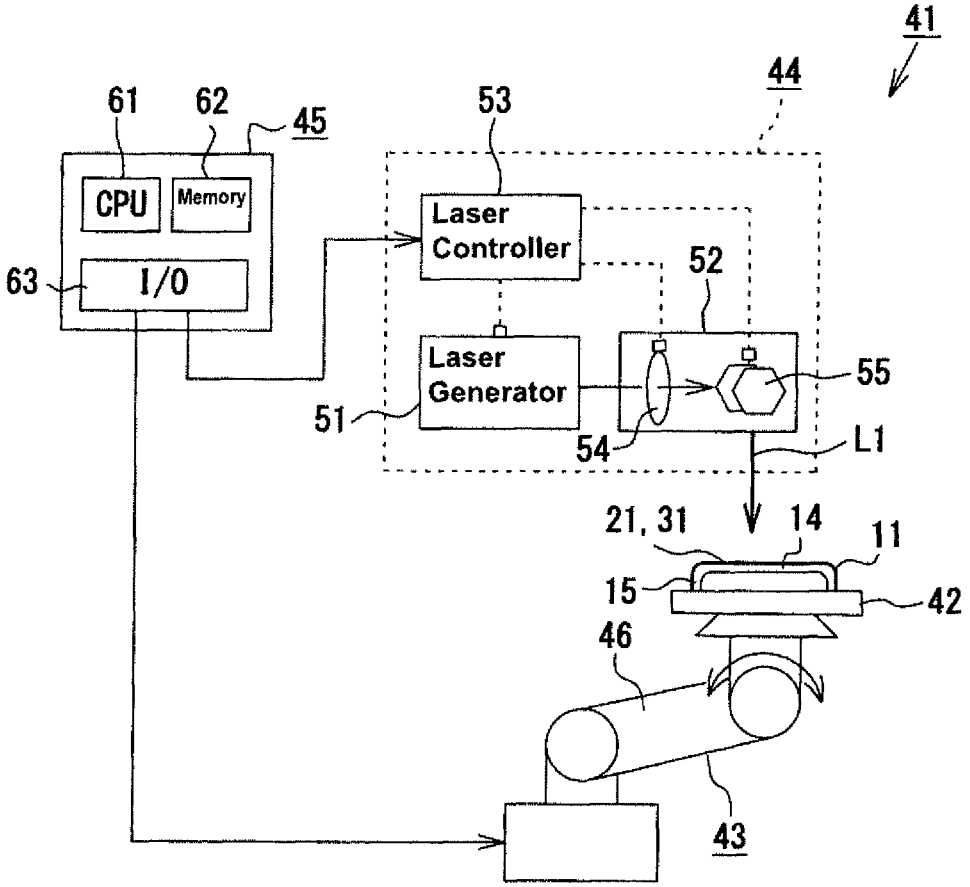
FIG. 1 is a layout-sketch of the laser-decorating device as an embodiment of this invention.
Figure 2:
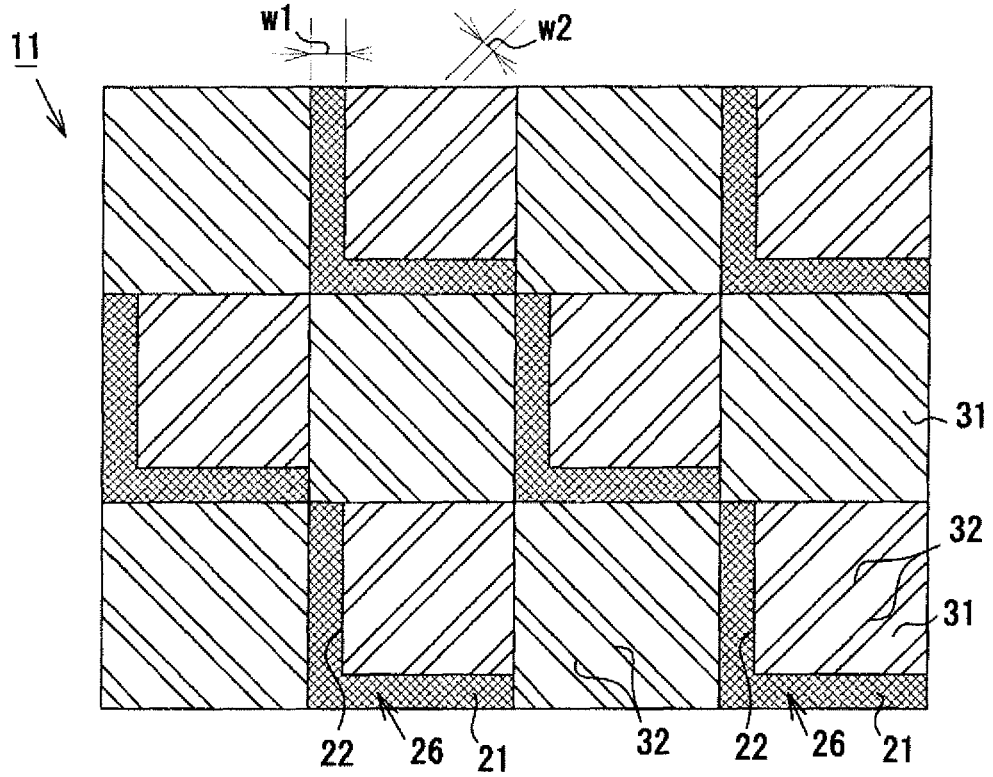
FIG. 2 is a partially enlarged plan-view of the automobile interior-part as an embodiment of this invention.
Figure 3:
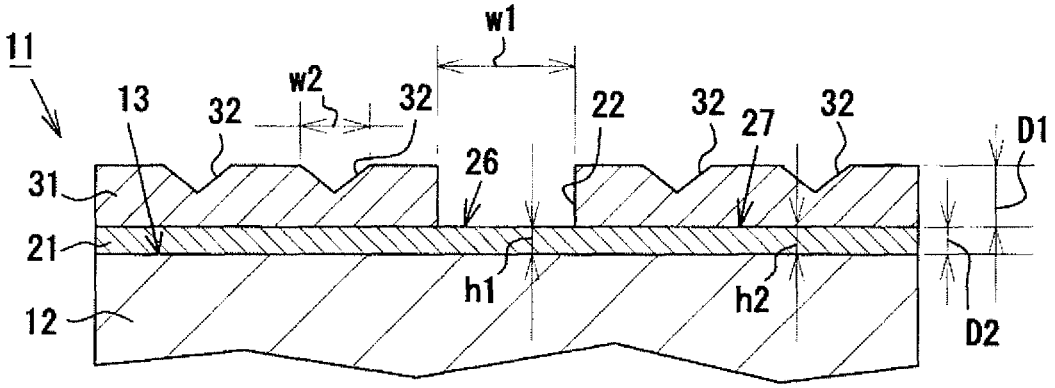
FIG. 3 is the enlarged cross-sectional view of the main part of the automobile interior-part as an embodiment of this invention.
Figure 4:
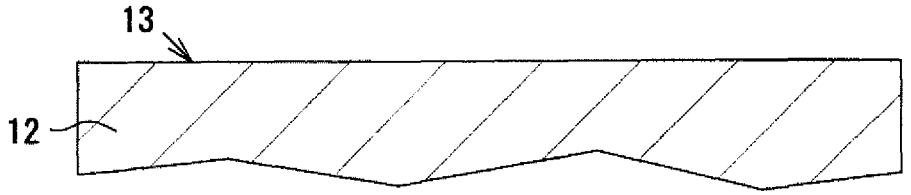
FIG. 4 is the enlarged cross-sectional view of the main part that explains the manufacturing process of the automobile interior-part as an embodiment of this invention.

As shown in FIGS. 2 and 3, the automobile interior-part 11 (i.e. the decorated part) of this invention comprises a three-dimensional resin-base material 12 and a plurality of coat-layers (the first base coat-layer 21B, the second base coat-layer 21C and surface coat-layer 31) formed in a laminated fashion so as to cover the surface 13 of the resin base-material 12. The resin base-material 12 as the embodiment of this invention is described as comprising a flat-shaped main part 14 and a pair of side parts 15 set so as to connect to the flat-shaped main part 14 (see FIG. 1). Since the angle between the main part 14 and the pair of side parts 15 is approximately 90 degrees, this resin base-material 12 is of substantially a U-shaped form. The automobile interior-part 11 as the embodiment of this invention is a part for configuring e.g. an armrest of an automobile door.

For example, an ABS resin or the like is used as the resin-base material 12 of the embodiment of this invention. It is possible also to choose a resin material such as a PC resin or a mixture of the ABS resin and the PC resin. The color of the resin base-material 12 is not specified. Any color of such resin material can be used according to the product feature, type or the like. However, the color black is used here in this invention.

The first base coat-layer 21B is formed on the surface 13 of the resin-base material 12. The first base coat-layer 21B is made of a coat-layer colored in a highly light color at a lightness-level of 70 or more (specifically, of a white-resin material at a lightless-level of 80 or more; of a milky-white resin-material at a lightness-level of 70 or more; of a grayish-white resin-material at a lightness-level of 70 or more; or made of an ivory-resin material colored at a lightness level of 70 or more). Of the above coloring designation of the first base coat-layer 21B, "a highly light color at a lightness level of 70 or more" and not only a non-chromatic color is used. Yet, a slightly chromatic color can be used.

Here, the thickness of the first base coat-layer 21B is not particularly limited, but it is favorable to set the thickness at least at 5 μm or more, because if the thickness of the first base coat-layer 21B is too thin, the infrared laser L1 is insufficiently reflected by the base coat-layer 21B in the laser-decorating process. Yet, going through the side of the resin base-material 12 carries the high risk that the heat of the infrared laser L1 is likely to be absorbed therein. In this case, gasification of the resin base-material 12 cannot be effectively prevented, and then an air-foam-induced bulge is likely to be formed. Considering such circumstances, it is preferable to set the thickness of the first base coat-layer 21B at 10 to 30 μm (specifically at 15 to 20 μm for the embodiment of this invention). In fact, the thickness of the first base coat-layer 21B should be minimal, since the first base coat-layer 21B is simply for providing reflexibility of the infrared laser L1. Also, increasing the thickness of the base coat-layer 21 unnecessarily (such as at 30 μm or more) may result in higher costs in production.

The second base coat-layer 21C, colored in a chromatic color except in black and white, is formed on the surface of the first base coat-layer 21B. Specifically, the second base coat-layer 21C, colored in red by adding a red pigment, is formed, and, as for the embodiment of this invention, is colored in red at a lightness-level of about 90 and at the chromatic-value of about 90.

The surface coat-layer 31, colored in a low-light color at a lightness-level of 20 or less, is formed on the second base coat-layer 21C. Specifically, by adding carbon black as a black pigment (of a content of four percent per volume or more), the surface coat-layer 31, colored in black at a lightness-level of about 18 and at the chromatic-value of about 2, is formed. The surface coat-layer 31 is colored by using a black pigment for the embodiment of this invention, but a dark color other than black (e.g. a blackish green, a blackish brown or the like) can be used if the condition of the lightness-level being 20 or less is satisfied. Specifically, it is possible to color the surface coat-layer 31 by mixing a black pigment with a dark chromatic color pigment other than black, accordingly.

The thickness of the surface coat-layer 31 is set greater than that of the second base coat-layer 21C. Specifically, the former should be 20 μm to 40 μm (approximately 30 μm for the embodiment of this invention), and the latter should be 10 μm to 20 μm (approximately 15 μm for the embodiment of this invention). Making the thickness of the surface coat-layer 31 less than that of the second base coat-layer 21C may inhibit the function of the surface coat-layer 31 as being a sufficient protective-layer on the uppermost surface of the surface coat-layer 31 and may also make it difficult to form the second laser-processed groove 32. In addition, the thickness of the second base coat-layer 21C should be minimal, since the base coat-layer 21C is simply for providing contrast in coloring. Also, increasing the thickness of the base coat-layer 21C unnecessarily may result in higher costs in production.

As shown in FIGS. 2 and 3, a plurality of two different laser-processed grooves 22, 32 respectively are formed in the surface coat-layer 31 as the embodiment of this invention. Specifically, as shown in FIG. 2, two rectangular-shaped patterns are drawn on the surface of the surface coat-layer 31. One of two such patterns incorporates both of the two different laser-processed grooves 22, 32, with a plurality of second laser-processed grooves 32 therein drawn in parallel obliquely upward to the right. The other drawn pattern incorporates only the one type of laser-processed grooves 32 that are plurally drawn therein in parallel obliquely upward to the left. Also, these two drawn patterns are alternately provided.

As shown in FIG. 3, the first laser-processed groove 22 fully penetrates the surface coat-layer 31 to expose partially the surface of the second base coat-layer 21C that is red in color. The first laser-processed groove 22 as the embodiment of this invention is formed L-shape in planar view. On the other hand, the second laser-processed groove 32 is shallower than the first laser-processed groove 22 and is formed so as not to penetrate the surface coat-layer 31. Specifically, the depth of the first laser-processed groove 22 is 20 μm to 40 μm (approximately 30 μm for the embodiment of this invention), and the depth of the second laser-processed groove 32 is 5 μm to 15 μm (approximately 10 μm for the embodiment of this invention). Also, the width w1 of the first laser-processed groove 22 is greater than the width w2 of the second laser-processed groove 32. Specifically, the width of the former should be set at 80 μm to 150 μm (approximately 100 μm, for the embodiment of this invention), and the width of the latter should be set at 50 μm to 100 μm (approximately 70 μm for the embodiment of this invention).

The exposed surface-area 26 of the second base coat-layer 21C at the bottom of the first laser-processed groove 22 is relatively flat, and its arithmetic-average roughness (Ra) is 2 μm or less. The maximum height (Ry) of the exposed area 26 is 7 μm or less, and the 10-point average roughness (Rz) of said exposed area 26 is 8 μm or less. The non-exposed area 27 of the second base coat-layer 21C not at the bottom of the first laser-processed groove 22, is of average value in height h1 from the standard point, that is, from the surface 13 of the resin base-material 12 up to the surface of the exposed area 26, is 100 or more and 130 or less, under the condition that the average value in height h2 from the standard point, that is, from the surface 13 of the resin base-material 12 up to the surface of the non-exposed area 27 is 100.

FIG. 1 shows the laser-decorating device 41 used in providing a design on the pre-decorated automobile interior-part 11. Such laser-decorating device 41 as the embodiment of this invention comprises a supporting table 42 for supporting the automobile interior-part 11; a work-displacement robot 43 for moving the supporting table 42 to change the posture and position or the like of said automobile interior-part 11; a laser-irradiating device 44 for irradiating the infrared laser L1 onto the decorated-surface of the automobile interior-part 11; and a control device 45 for activating and controlling the work-displacement robot 43 and the laser-irradiating device 44.

The work-displacement robot 43 comprises a robot arm 46 with a supporting table 42 at the tip. Of the work-displacement robot 43, the robot arm 46 is activated to move the supporting table 42 from side to side, up and down and in a rotational direction to change the position and posture of the automobile interior-part 11, thus changing the irradiation position and irradiation angle of the infrared laser L1 against the decorated-surface of the automobile interior-part 11.

The laser-irradiating device 44 comprises a laser generator 51 for generating the infrared laser L1 at a given wavelength (e.g. a $YVO_4$ laser of a wavelength of 1,064 nm); a laser deflector 52 for deflecting the infrared laser L1; a laser controller 53 for controlling the laser generator 51 and the laser deflector 52. The laser deflector 52 is an optics system comprising a lens 54 and a reflective mirror 55. The irradiation position and the focal point of the infrared laser L1 can be adjusted by changing the position of the lens 54 and the reflective mirror 55. The laser controller 53 controls the laser generator 51 and the laser deflector 52, thus adjusting the laser-irradiation conditions such as the irradiation intensity and the scanning rate of the infrared laser L1.

The controller 45 is configured of a well-known computer made of a CPU 61, of a memory 62, and of an input-output port 63 or the like. The controller 45 is connected electrically to the work-displacement robot 43 and the laser-irradiating device 44 that are driven and controlled by various drive-signals.

The memory 62 of the controller 45 incorporates programs and data for drawing the design onto the decorative surface of the automobile interior-part 11. Specifically, such data is configuration-data for indicating the three-dimensional formation of the automobile interior-part 11 and other data such as pattern-data or the like according to the pattern to be drawn onto said automobile interior-part 11. Also, the memory 62 incorporates the programs and the data for controlling the work-displacement robot 43 and the laser-irradiating device 44.

The method for manufacturing the automobile interior-part 11 is described in reference to FIGS. 4 to 7.

Figure 5:
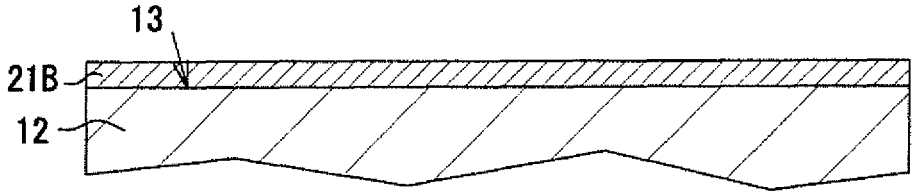
FIG. 5 is the enlarged cross-sectional view of the main part that explains the manufacturing process of the automobile interior-part as an embodiment of this invention.
Figure 6:
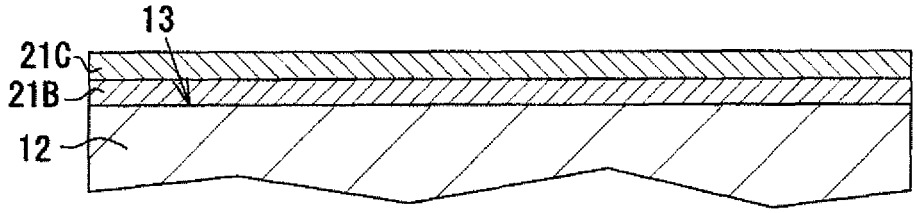
FIG. 6 is the enlarged cross-sectional view of the main part that explains the manufacturing process of the automobile interior-part as an embodiment of this invention.
Figure 7:
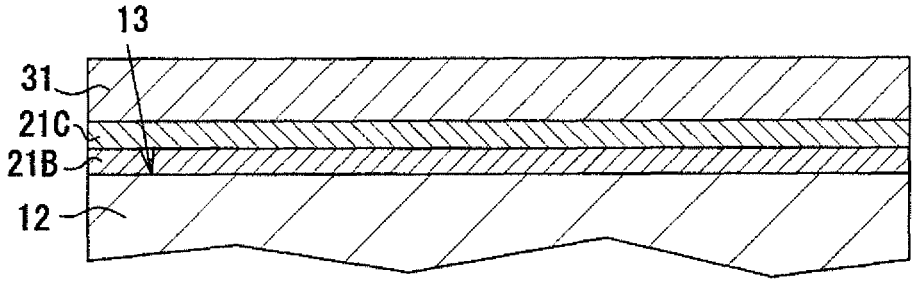
FIG. 7 is the enlarged cross-sectional view of the main part that explains the manufacturing process of the automobile interior-part as an embodiment of this invention.

Firstly, prepare the resin base-material formed by using the ABS resin (see FIG. 4) Then, make the first base coat-layer 21B, colored in white at a lightness-level of 80 or more, or colored in a milky-white at a lightness-level of 70 or more, or colored in a grayish-white or in ivory, on the surface 13 of the resin base-material 12 by the conventionally known method (see FIG. 5 of the first base coat-layer-forming process). Furthermore, make the second base coat-layer 21C, colored in red by adding the red pigment, on the first base coat-layer 21B by the conventionally known method (see the FIG. 6 of the second base coat-layer-forming process). After that, make the surface coat-layer 31 in a less-light color at a lightness-level of 20 or less on the second base coat-layer 21C (see FIG. 7 of the surface coat-layer-forming process), so that the whole area of the surface 13 of the three-dimensional resin base-material 12 (of the main part 14 and of the side parts 15) becomes a decorative surface.

In the next laser-decorating process, first set the resin base-material 12 on the supporting table 42 of the work-displacement robot 43 (see FIG. 1). Next, the CPU 61 retrieves from the memory 62 the laser-irradiation data for irradiating the laser. The CPU 61 then produces a drive-signal according to the laser-irradiation data and then emits such drive-signal to the laser-irradiating device 44, which then irradiates the infrared-laser L1 according to the drive-signal being emitted by the CPU 61. Also, the laser controller 53 of the laser-irradiating device 44 makes the laser generator 51 irradiate the laser L1 and controls the laser deflector 52 according to the pattern of the given image data. Such control determines the irradiating position and the focal point of the infrared laser L1. All of the above controls make it possible to conduct a certain laser irradiation to form a group of laser-processed grooves of the multiple laser-processed grooves 22, 32, thus providing a certain pattern, as shown in FIG. 2, and therefore providing a fine decoration on the surface of the automobile interior-part 11.

In the laser-decorating process, the laser-irradiation is conducted specifically in the following order.

Figure 8:
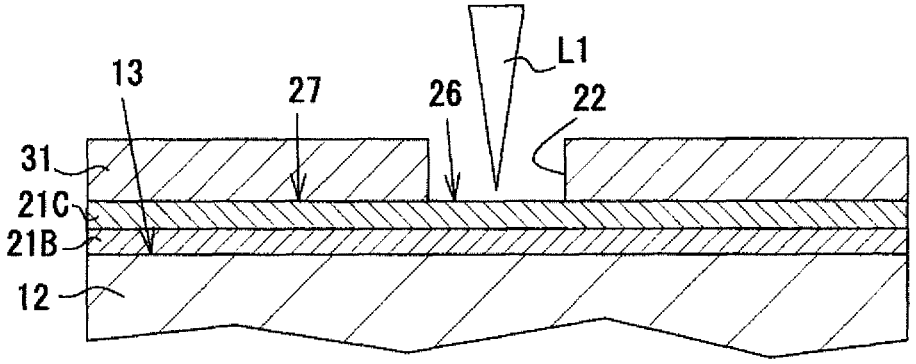
FIG. 8 is the enlarged cross-sectional view of the main part that explains the manufacturing process of the automobile interior-part as an embodiment of this invention.
Figure 9:
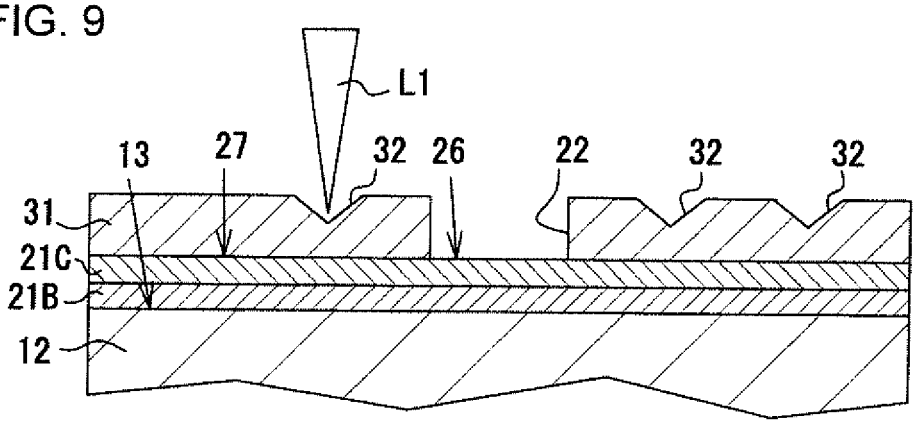
FIG. 9 is the enlarged cross-sectional view of the main part that explains the manufacturing process of the automobile interior-part as an embodiment of this invention.

Firstly, make the first laser-processed groove 22, which penetrates the surface coat-layer 31, to expose partially the second base coat-layer 21C, by irradiating the infrared laser L1 onto the surface coat-layer 31 (see FIG. 8). Then, without penetrating the surface coat-layer 31, make the second laser-processed groove 32, which is shallower than the first laser-processed groove 22, on the surface coat-layer 31 by irradiating the infrared laser L1 onto the surface of said surface coat-layer 31 (see FIG. 9). The above ordered process prevents smoke and soot from gathering in the second laser-processed groove 32, while forming the first laser-processed groove 22, which brings the advantage of eliminating the possibility of gloss-deterioration.

Figure 10:
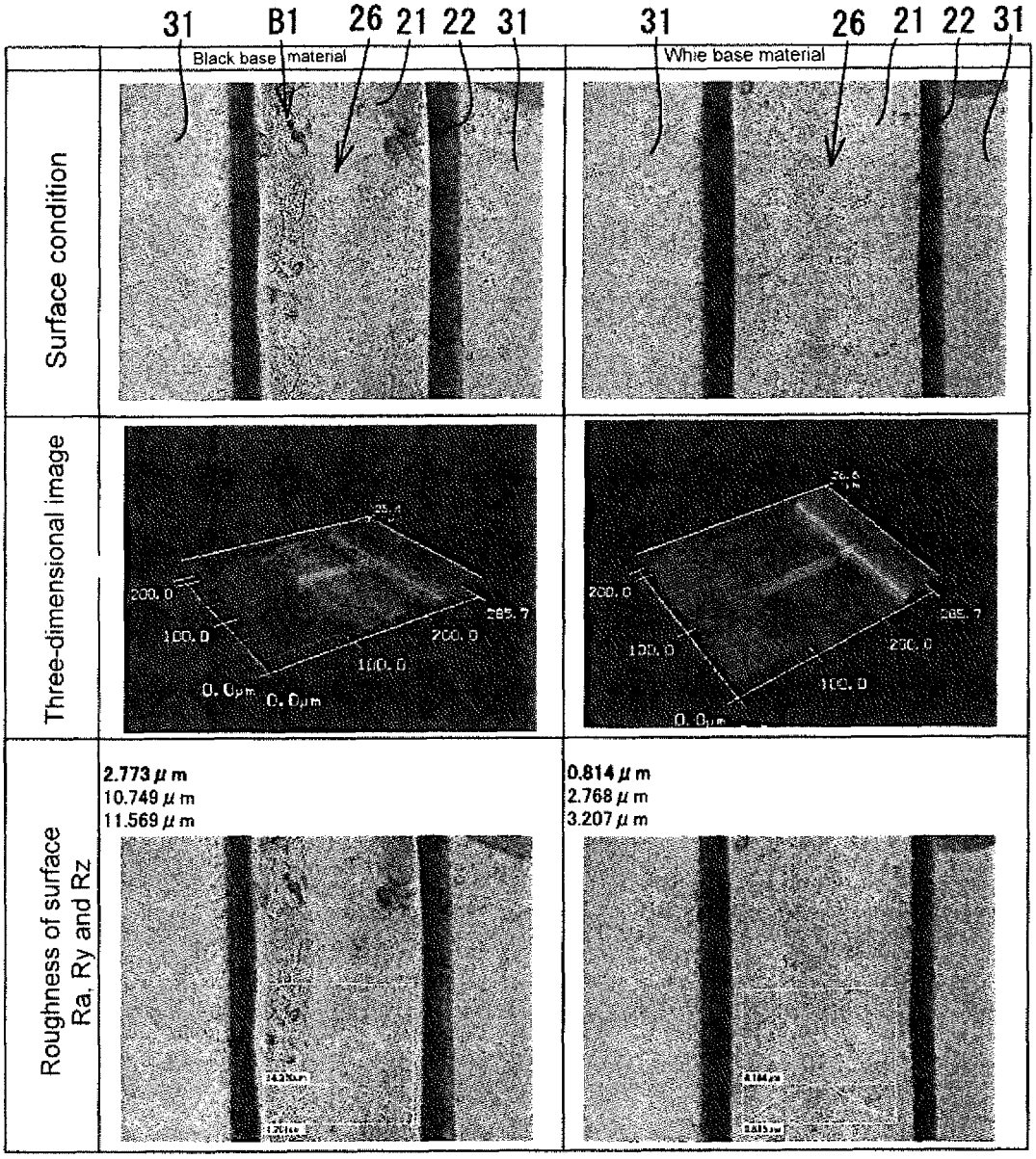
FIG. 10 shows photographs (in the left column) of the enlarged plan-view and of the three-dimensional image of the first laser-processed groove of the conventional automobile interior-part and shows (in the right column) photographs of the enlarged plan-view and of the three-dimensional image of the first laser-processed groove of the automobile interior-part as an embodiment of this invention.
Figure 11:
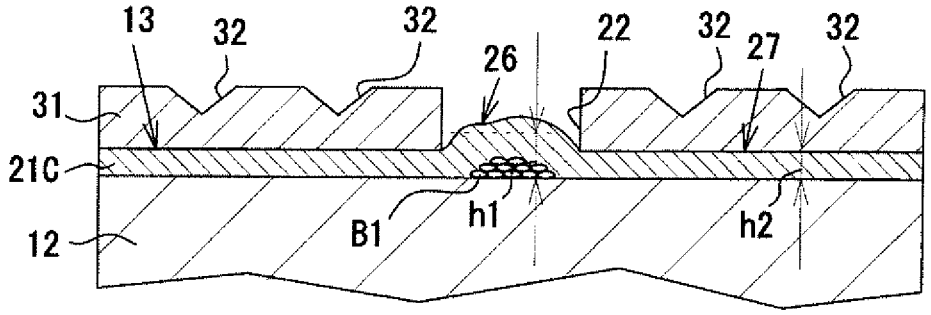
FIG. 11 is an enlarged cross-sectional view of the main-part of the conventional automobile interior-part as a comparative example.

The automobile interior-part 11 as the embodiment of this invention, and a comparative example of the conventional automobile interior-part, were actually made and observed. The result is as follows:

FIG. 10 shows photographs (in the left column) of the enlarged plan-view and of the three-dimensional image of the first laser-processed groove 22 of a conventional automobile interior-part and shows (in the right column) photographs of the enlarged plan-view and of the three-dimensional image of the first laser-processed groove 22 of the automobile interior-part 11 as an embodiment of this invention. FIG. 11 is an enlarged cross-sectional view of the main part of the conventional automobile interior-part as a comparative example. The only difference of this comparative example from the embodiment of this invention is that this comparative example does not have the first base coat-layer 21B.

As shown in FIG. 11, it was identified in the comparative example of the conventional automobile interior-part that the exposed area 26 of the second base coat-layer 21C at the bottom of the first laser-processed groove 22 bulges, that the surface-flatness of the exposed area 26 is less realized, and that an air-foam B1 is formed on the surface of the resin base-material 12 beneath the base coat-layer 21 of the exposed area 26 of the base coat-layer 21, which may suggest a deterioration of the adhesion between the resin base-material 12 and the second base coat-layer 21C. The laser-microscope determination of the surface-roughness of the exposed area 26 of the second base coat-layer 21C showed that the arithmetic-average roughness (Ra) was 2.773 μm, that the maximum height (Ry) was 10.749 μm, and that the ten-point average roughness (Rz) was 11.569 μm respectively. Also, the planar-view microscope-determination of the exposed area 26 identified that the formed air-foam B1 deteriorates the surface of the exposed area 26 (see the left column of FIG. 10). The planar view unaided observation of the comparative example of the conventional automobile-interior-part showed that the red color of the exposed area 26 was unclear and of a less high contrast.

Contrarily, as shown in FIGS. 2 and 3, it was identified in the automobile interior-part 11 as the embodiment of this invention that the surface of the exposed area 26 of the second base coat-layer 21C at the bottom of the first laser-processed groove 22 is not bulged, that the flatness of the exposed area 26 is realized, that such realized flatness is kept at a high level, and that there is not an air-foam B1 formed at all on the surface of the resin base-material 12 beneath the base coat-layer at the bottom of the exposed area 26, which means that the adhesion between such resin base-material 12 and base coat-layer is kept in a preferable state. The laser-microscope determination of the surface-roughness of the exposed area 26 of the second base coat-layer 21C showed that the arithmetic-average roughness (Ra) was 0.814 μm, that the maximum height (Ry) was 2.768 μm, and that the ten-point average roughness (Rz) was 3.207 μm, which were obviously less than the values of the comparative example. The planar-view unaided determination of the comparative example of the automobile interior-part 11 of this invention showed that the surface condition of the exposed area 26 was extremely good (see the right column of FIG. 10). The planar view unaided observation of the automobile interior-part 11 of this invention showed that the red color of the exposed area 26 was clear and of a high contrast.

Therefore, the following effects can be achieved by the embodiments of this invention.

(1) In the manufacturing process of the automobile interior-part 11 as an embodiment of this invention, the first base coat-layer 21B, colored in a highly light color at a lightness-level of 70 or more, is formed on the resin base-material 12. Then, the laser-decorating process is proceeded. As such, in the laser-decorating process, the infrared laser L1 is reflected by the first base coat-layer 21B, thus avoiding heat absorption. Moreover, the resin will not be gasified and thus an air foam-induced bulge is not readily formed. Therefore, the flatness of the exposed area 26 of the second base coat-layer 21C at the bottom of the first laser-processed groove 22 is realized. As a result, the exposed area 26 shows a clear color and a high contrast, thus making it possible to obtain an automobile interior-part 11 with an excellent design. Also, the adhesion of the base coat-layer 21 against the resin base-material 12 does not lessen, thus making it possible to obtain a reliable decorated-part 11.

(2) In the laser-decorating process of the method for manufacturing the embodiment of this invention, in addition to the first laser-processed groove 22, the second laser-processed groove 32 is made, so that a complex and fine design can be expressed, thus making it possible to improve the excellency of the design.

(3) In the laser-decorating process of the method for manufacturing an embodiment of this invention, the second laser-processed groove 32 is made after the first laser-processed groove 22 is made. If the first laser-processed groove 22 of a relatively deep groove is made later than the second laser-processed groove 32 of a relatively shallow groove, then more gas is produced in the making of the first laser-processed groove 22, which causes soot and smoke to gather in the second laser-processed groove 32, which could result in less gloss of the second laser-processed groove 32. Contrarily, the embodiment of this invention that the first laser-processed groove 22 is started to be made in advance of the second laser-processed groove 32 prevents smoke and soot from gathering in the second laser-processed groove 32, which eliminates the risk of gloss-deterioration, thus making it possible to obtain a high-quality-designed automobile interior-part 11 of a clear second-laser-processed groove 32.

(4) The automobile interior-part 11 as an embodiment of this invention comprises the second base coat-layer 21C colored in red as a chromatic color and the surface coat-layer 31 colored in black and to be formed on the base coat-layer 21. Of this automobile interior-part 11, the first laser-processed groove 22 penetrates the surface coat-layer 31 to expose partially the second base coat-layer 21C, while the second laser-processed groove 32 that is shallower than the first laser-processed groove 22 does not penetrate the surface coat-layer 31. Also, of the exposed area 26 of the second base coat-layer 21C, the arithmetic-average roughness (R1) is 2 μm or less, the maximum height (Ry) is 7 μm or less, and the 10-points average roughness (Rz) is 8 μm or less, which makes the flatness of the exposed area 26 realized, thus making it possible to achieve an exposed area 26 with distinctive coloring and high contrast.

(5) Of the automobile interior-part 11 as an embodiment of this invention, the average value in the height h1 from the surface 13 of the resin base-material 12, as the standard point, up to the surface of the exposed area 26, is within the preferable range of 100 or more and 130 or less (specifically approximately 100). Contrarily, of the comparative example of the conventional automobile interior-part, the height h1 greatly exceeds the above preferable range (specifically over 150). In other words, the height of the bulge of the exposed area 26 of the automobile interior-part 11 of this invention, compared to the comparative example, is obviously very low, with the flatness of the exposed area realized, which makes the coloring of such an area distinctive and the contrast greater.

(6) Of the automobile interior-part 11 as an embodiment of this invention, the thickness D1 (see FIG. 3) of the surface coat-layer 31 is greater than the thickness D2 of the second base coat-layer 21C. Making the thickness D1 of the surface coat-layer 31 less than the thickness D2 of the base coat-layer 21 may make it impossible to provide the function of the surface coat-layer 31 as being a sufficient protective layer on the uppermost surface of the surface coat-layer 31. In addition, the thickness of the base coat-layer 21 should be minimal, since the second base coat-layer 21C is simply for providing contrast. Increasing the thickness of the base coat-layer 21 unnecessarily may result in higher costs in production. On the contrary, the embodiment of this invention that the thickness D1 of the surface coat-layer 31 is greater than the thickness D2 of the second base coat-layer 21C can provide the function of the surface coat-layer 31 as being a protective layer on the uppermost surface of the surface coat-layer 31 and can prevent an increase of unnecessary thickness of the second base coat-layer 21C, thus making it possible to avoid higher costs in production. As such, the first laser-processed groove 22 and the second laser-processed groove 32 are readily made respectively, thus making it possible to avoid higher costs in production.

Each embodiment of this invention can be modified, as described below.

As described in the above embodiment of this invention, the second base coat-layer 21C is colored in red. However, it is possible to color it in another chromatic color (e.g. in blue, green, brown, orange, purple, yellow or the like).

As described in the above embodiment of this invention, the second base coat-layer 21C is only a single coat-layer colored in red. However, double coat-layers in different colors can be adapted. For example, regarding such second base coat-layers 21C, 21C, it is possible to color the bottom layer in red and to color the upper layer in blue. The second base coat-layer 21C in red has the feature of not easily absorbing the infrared-laser L1, compared to the second base coat-layer 21C in blue, so that the infrared laser L1 penetrates the surface coat-layer 31, the first laser-processed groove 22 that partially exposes the second base coat-layer 21C in blue, as well as the surface coat-layer 31 and the second base coat-layer 21C in blue, thus making it possible partially to expose the second base coat-layer 21 in red. Therefore, it is possible to obtain the automobile interior-part 11 comprising the two color-exposed areas 26 of distinctive coloring and of great contrast. Also, instead of the second base coat-layer 21C being blue, it is possible to provide a coat-layer of another color that absorbs the energy of the infrared laser L1 more readily than red, and one that contains a chromatic color-pigment other than blue. Furthermore, it is possible to provide a coat-layer that contains a mixture of silver pigment and black pigment in a certain proportion.

As described in the above embodiment of this invention, the $YVO_4$ laser is used. However, it is not limited to that. The laser processing can be done using another solid-state laser that can irradiate the infrared laser L1 (e.g. a YAG laser, a ruby laser or the like).

As described in the embodiment of this invention, the method for manufacturing decorative parts is embodied in the method for manufacturing component parts such as an armrest of a door as one of the automobile interior parts. However, it is possible to be embodied in this method for manufacturing decorative parts other component parts of automobile interior parts such as console boxes, instrument panels, sensor clusters, cup holders, glove compartments, upper boxes or safety-assist handles or the like. Besides automobile interior parts, this invention can be naturally embodied as a method for manufacturing decorative parts such as automobile exterior parts (e.g. radiator grills, emblems, mud guards or the like) or for manufacturing the decorative veneers of furniture, electric appliances or the like.

Besides the technical ideas of this invention, as described above, other technical ideas to be understood are described hereinafter.

(1) According to any one of the first through eleventh aspects as described above, the surface roughness (Ry) of the exposed area at the bottom of the first laser-processed groove of the second base coat-layer is 7 μm or less.

(2) According to any one of the first through eleventh aspects as described above, the surface roughness (Rz) of the exposed area at the bottom of the first laser-processed groove of the second base coat-layer is 8 μm or less.

(3) According to any one of the first through eleventh aspects as described above, there is no bulge between the surface of the resin base-material and the first base coat-layer or between the first base coat-layer and the second base coat-layer.

(4) According to any one of the first through eleventh aspects as described above, of the second base coat-layer, the adhesion-intensity of the area at the bottom of the first laser-processed groove is the same as that of the area not at the bottom of the first laser-processed groove.

(5) According to any one of the first through eleventh aspects as described above, the second base coat-layer is red.

(6) According to any one of the first through eleventh aspects as described above, the second base coat-layer is made of two layers. The lower layer is colored in red, and the upper layer is colored in blue.

(7) According to any one of the first through eleventh aspects as described above, the thickness of the surface coat-layer is 20 μm to 40 μm, the thickness of the first base coat-layer is 15 μm to 20 μm, and the thickness of the second base coat-layer is 10 μm to 20 μm.

DESCRIPTION OF REFERENCE NUMERALS

11: Automobile interior-part as the decorated-part
12: Resin base-material
13: Surface of the resin base-material
21B: First base coat-layer
21C: Second base coat-layer
22: First laser-processed groove
26: Exposed area
27: Non-exposed area
31: Surface coat-layer
32: Second laser-processed groove
D1: Thickness of the second base coat-layer
D2: Thickness of the surface coat-layer
h1: Height from the surface of the resin base-material as the standard point up to the surface of the non-exposed area
h2: Height from the surface of the resin base-material as the standard point up to the surface of the exposed area
L1: Infrared laser
w1: Width of the first laser-processed groove
w2: Width of the second laser-processed groove

The invention claimed is:

1. A decorated-part of which a fine decoration is provided on a surface of the decorated-part by a laser-processed groove, the decorated part comprising:

a resin base-material;

the first base coat-layer formed on a surface of the resin base-material;

at least one second base coat-layer formed on a surface of the first base coat-layer; and a surface coat-layer formed on the second base coat-layer, a thickness of the surface coat-layer being greater than a thickness of the second base coat-layer; and further characterized in comprising a first laser-processed groove that goes through the surface coat-layer and partially exposes the second base coat-layer but does not expose the first base coat-layer, and a second laser-processed groove, which has a groove depth less than a groove depth of the first laser-processed groove, the second laser-processed groove not penetrating the surface coat-layer, the surface coat-layer, including the second laser-processed groove, being a single layer colored in black, an entire top surface of the surface coat-layer being totally visible;

the first base coat-layer being colored in white, invisible, and having no surface design; and the second base coat-layer being colored in a chromatic color brighter than the color of the surface coat-layer, a top surface of the second base coat layer being partially visible;

wherein a roughness (Ra) of the exposed area, which is at a bottom of the first laser-processed groove of the second base coat-layer, is 2 μm or less, wherein the surface coat layer further comprises:

a plurality of first drawn patterns of rectangular shape; and a plurality of second drawn patterns of rectangular shape;

each of the first drawn patterns including the second laser processed grooves, the second laser processed grooves drawn in parallel and extending obliquely upward to the right in plan view for each of the first drawn patterns;

each of the second drawn patterns including the second laser processed grooves, the second laser processed grooves drawn in parallel and extending obliquely upward to the left in plan view for each of the second drawn patterns;

the first and second drawn patterns adjacent to each other on the surface coat-layer.

2. A decorated-part according to claim 1, characterized in that a width of the first laser-processed groove is greater than a width of the second laser-processed groove.

3. A decorated part according to claim 1, further wherein the second laser-processed groove is spaced from a side wall of the first laser-processed groove such that a portion of the surface coat-layer is positioned between the side wall and the second laser-processed groove.

* * * * *